US009475249B2

(12) United States Patent
Pettersson et al.

(10) Patent No.: US 9,475,249 B2
(45) Date of Patent: Oct. 25, 2016

(54) AUTOMATED GLUING DEVICE

(75) Inventors: Niklas Pettersson, Sandy, UT (US); Ryan Osterhout, West Haven, UT (US)

(73) Assignee: Packsize LLC, Salt Lake City, UT (US)

( * ) Notice: Subject to any disclaimer, the term of this patent is extended or adjusted under 35 U.S.C. 154(b) by 1105 days.

(21) Appl. No.: 13/129,095

(22) PCT Filed: Nov. 13, 2009

(86) PCT No.: PCT/US2009/064477

§ 371 (c)(1), (2), (4) Date: Oct. 3, 2011

(87) PCT Pub. No.: WO2010/057053

PCT Pub. Date: May 20, 2010

(65) Prior Publication Data

US 2012/0028776 A1 Feb. 2, 2012

Related U.S. Application Data

(60) Provisional application No. 61/114,282, filed on Nov. 13, 2008, provisional application No. 61/259,211, filed on Nov. 8, 2009.

(30) Foreign Application Priority Data

Nov. 12, 2009 (WO) ..... PCT/US2009/064248

(51) Int. Cl.
*B31B 1/62* (2006.01)
*B31B 3/00* (2006.01)

(52) U.S. Cl.
CPC . *B31B 3/00* (2013.01); *B31B 1/62* (2013.01); *B31B 2201/267* (2013.01); *B31B 2201/2691* (2013.01); *B31B 2201/6017* (2013.01); *B31B 2203/066* (2013.01); *B31B 2203/082* (2013.01)

(58) Field of Classification Search
CPC ... B31B 2201/6017; B31B 1/80; B31B 1/00; B31B 2201/6026; B31B 1/26; B31B 1/64; B31B 2201/603; B31B 1/48; B31B 2201/60; B31B 2201/6091; B31B 2203/00; B31B 2217/088; B31B 1/74; B31B 1/62; B65D 5/326; B65D 5/20
USPC ..... 493/128, 130, 131, 141, 142, 144, 151, 493/181, 183, 127, 129, 68, 69; 53/377.4
See application file for complete search history.

(56) References Cited

U.S. PATENT DOCUMENTS 2,637,251 A 5/1953 Spiess
2,690,156 A * 9/1954 Shields ..... B31B 1/62 118/242

(Continued)

FOREIGN PATENT DOCUMENTS

CN 1810501 8/2006
CN 101094766 12/2007

(Continued)

OTHER PUBLICATIONS

Search Report for Chinese Application No. 200980150097.1 dated Jan. 8, 2013.

(Continued)

*Primary Examiner* — Andrew M Tecco
*Assistant Examiner* — Chelsea Stinson
(74) *Attorney, Agent, or Firm* — Workman Nydegger

(57) ABSTRACT

A gluing device for automatically gluing and folding a gluable item. The gluing device includes a support structure upon which a gluing apparatus and a support plate assembly are mounted. The support plate is configured for supporting and aligning a gluable item for gluing and assembly by the gluing apparatus. The gluing apparatus includes a first clamp configured for selectively and securely holding a first portion of the gluable item on the support plate, a glue dispensing nozzle fluidly coupled to a glue supply, and a folding apparatus configured for folding the first portion of the gluable item onto a second portion of the gluable item after glue has been applied. A method for automatically gluing and folding a gluable item is also disclosed.

18 Claims, 14 Drawing Sheets

(56) References Cited

U.S. PATENT DOCUMENTS

| | | | | | |
|---|---|---|---|---|---|
| 2,848,926 | A * | 8/1958 | Gschwind | B31B 3/48 | 493/168 |
| 3,061,167 | A | 10/1962 | Haack | | |
| 3,105,419 | A | 10/1963 | La Bombard | | |
| 3,884,130 | A | 5/1975 | Stolkin et al. | | |
| 3,964,374 | A * | 6/1976 | Stolkin et al. | 493/6 | |
| 4,119,058 | A | 10/1978 | Schmermund | | |
| RE30,325 | E | 7/1980 | Waldbauer | | |
| 4,272,235 | A | 6/1981 | Barnett | | |
| 4,516,210 | A * | 5/1985 | Dahlke | B31B 1/74 | 493/1 |
| 4,608,038 | A | 8/1986 | Virta et al. | | |
| 4,636,185 | A * | 1/1987 | Carter et al. | 493/127 | |
| 4,894,104 | A | 1/1990 | Hemus | | |
| 5,071,401 | A * | 12/1991 | Bertsch | B31B 1/36 | 118/249 |
| 5,188,695 | A | 2/1993 | Colton | | |
| 5,236,408 | A | 8/1993 | McAdam, III et al. | | |
| 5,863,380 | A | 1/1999 | Gambetti | | |
| 6,066,080 | A * | 5/2000 | Benoit | B31B 1/74 | 493/93 |
| 6,419,750 | B1 | 7/2002 | Tabak | | |
| 6,673,152 | B2 * | 1/2004 | Guzzon | B31B 1/62 | 118/315 |
| 7,601,218 | B2 | 10/2009 | Stepaniak | | |
| 2011/0294638 | A1 * | 12/2011 | Tosevski | B31B 1/04 | 493/123 |
| 2012/0129670 | A1 | 5/2012 | Pettersson | | |
| 2014/0371045 | A1 * | 12/2014 | Bruneau | B31B 1/00 | 493/52 |

FOREIGN PATENT DOCUMENTS

| | | | | |
|---|---|---|---|---|
| CN | 200998927 | | 1/2008 | |
| CN | 201128254 | | 10/2008 | |
| CN | 102264532 | | 11/2011 | |
| CN | 102264533 | | 11/2011 | |
| DE | 229667 | | 11/1985 | |
| DE | 3519017 | | 11/1986 | |
| DE | 3519017 | A1 * | 11/1986 | B31B 1/12 |
| EP | 2364250 | | 9/2011 | |
| EP | 2364251 | | 9/2011 | |
| GB | 2085791 | | 5/1982 | |
| GB | 2103145 | | 2/1983 | |
| JP | 56122295 | | 9/1981 | |
| JP | 57192829 | | 11/1982 | |
| JP | 5991077 | | 5/1984 | |
| JP | 64044739 | | 2/1989 | |
| JP | 05-508141 | | 11/1993 | |
| JP | 07-330206 | | 12/1995 | |
| JP | 2001171019 | | 6/2001 | |
| JP | 2001205988 | | 7/2001 | |
| JP | 2004058665 | | 2/2004 | |
| JP | 2005280802 | | 10/2005 | |
| JP | 2009166625 | | 7/2009 | |
| JP | 2012508661 | | 4/2012 | |
| JP | 2012509778 | | 4/2012 | |
| RU | 2011123972 | | 12/2012 | |
| RU | 2011123973 | | 12/2012 | |
| WO | 92-08653 | | 5/1992 | |
| WO | 9308979 | | 5/1993 | |
| WO | 2010056894 | | 5/2010 | |
| WO | 2010057053 | | 5/2010 | |

OTHER PUBLICATIONS

International Search Report and Written Opinion for PCT/US2009/064248 dated Dec. 29, 2009.
U.S. Appl. No. 13/129,093, Nov. 5, 2014, Office Action.
European Search Report for EP09826874 dated Feb. 13, 2015.
European Search Report for EP09826772 dated Feb. 13, 2015.
European Search Report for EP09826772 dated Jun. 30, 2015.
U.S. Appl. No. 13/129,093, Apr. 23, 2015, Final Office Action.
International Search Report and Written Opinion for PCT/US2009/064477 dated Dec. 29, 2009.
U.S. Appl. No. 13/129,093, Jan. 15, 2016, Notice of Allowance.

* cited by examiner

AUTOMATED GLUING DEVICE

CROSS-REFERENCE TO RELATED APPLICATIONS

This application claims the benefit of, and priority to, U.S. Provisional Patent Application Ser. No. 61/114,282, filed on Nov. 13, 2008, and entitled "BOX GLUING DEVICE;" U.S. Provisional Patent Application Ser. No. 61/259,211, filed on Nov. 8, 2009, and entitled "AUTOMATED BOX GLUING DEVICE;" and PCT International Application No. PCT/US2009/064248, filed with the United States Receiving Office on Nov. 12, 2009, and entitled "BOX GLUING DEVICE" which are hereby expressly incorporated herein by this reference in their entireties.

BACKGROUND OF THE INVENTION

1. Technical Field

Exemplary embodiments of the invention relate to the manufacture and construction of packaging materials.

2. The Relevant Technology

Numerous devices are used in the corrugated board industry to convert a cutout blank into a corrugated box. Some of these devices are able to cut, crease, fold and/or glue corrugated blanks in order to create a box. The gluer is often grouped as one in a series of machines operating to convert paperboard blanks, one-by-one, into boxes. The gluer ordinarily receives a folded blank with four side-by-side panels that are separated from one another by longitudinal creases and slots. Each of the panels also includes opposing flaps that can be folded to form the top and bottom of the box. Additionally, one of the panels also includes a glue tab. The gluer applies glue to the glue tab and/or and adjacent panel and presses the glue tab against the adjacent panel, thereby creating a box with four connected sides.

Typical gluers are relatively large, complex machines. These machines often have conveyer belts for advancing the corrugated blanks through the machine. Typical gluers also include glue applicators that may be mechanically driven along a portion of the corrugated blank in order to apply glue to the glue tab. Additionally, many gluers include means for applying pressure to the glue tab, such as a pneumatic arm, in order to bond the glue to the glue tab and the adjacent panel. Because of the complex nature of typical gluing devices and the need to ensure proper timing of the glue dispenser and the other moving parts, gluers often have computers or other electronics that control the operation of the various parts of the machine to prevent the moving parts from colliding with one another. For example, the computer or other electronics may coordinate the timing and control the operation of one or more pneumatic arms for folding the box blank, a glue applicator for applying glue to the box blanks, and a compression device for applying pressure to the glued portions of the box blank, such that none of these components interferes with the others. The complex nature of these gluers, with the numerous moving parts and electronics, increases the cost of the machines as well as often requiring significant maintenance and operating expenses.

In addition to their relatively complex nature, typical gluers are often very large. A corrugated blank that is glued with a typical gluer is usually folded such that the glue flap extends down the middle of the corrugated blank. Gluers are therefore made with a large C-shaped frame. The bottom portion of the frame supports the corrugated blank during the gluing process. The top portion of the frame, which includes the glue applicator, extends over the top of the corrugated blank so as to be able to reach the glue flap in the middle of the corrugated blank. For larger sized corrugated blanks, gluers with even larger sized frames are needed. These large gluing machines can occupy valuable space in a manufacturing or other type of facility.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

Exemplary embodiments of the invention relate to the manufacture and construction of packaging materials. More particularly, embodiments relate to methods and devices for gluing packaging materials, such as packaging templates formed of corrugated board.

In one embodiment of the present invention, a gluing device is disclosed. In one aspect, the gluing device includes a support structure upon which a gluing apparatus and a support plate assembly are mounted. The support plate is configured for supporting and aligning a packaging material for gluing and assembly by the gluing apparatus. The gluing apparatus includes a first clamp configured for selectively and securely holding a first portion of the packaging material on the support plate, a glue dispensing nozzle fluidly coupled to a glue supply, and a folding apparatus configured for folding the first portion of the packaging material onto a second portion of the packaging material.

In one aspect, the glue dispensing nozzle is movably mounted to the support structure such that the glue dispensing nozzle can be selectively moved between a first position and a second position on the support structure to facilitate application of glue along a length of at least one edge surface of the packaging material. Optionally, the glue dispensing nozzle may be operatively coupled to a track structure and a drive assembly adapted to facilitate movement of the glue dispensing nozzle between the first and second positions. Optionally, the glue dispensing nozzle may be operatively coupled to at least a first sensor configured to detect the packaging material, so as to cause the glue dispensing nozzle to dispense glue onto the packaging material between a first end and a second end.

In another aspect, a folding apparatus is configured for folding the first portion of the packaging material onto a second portion of the packaging material after glue has been applied to at least one edge surface of at least one of the first portion or the second portion. Optionally, the first clamp and the folding apparatus may be motorized to facilitate holding and folding of the packaging material.

According to another embodiment of the present invention, a method for constructing a box is disclosed. The method includes providing a box blank that has a plurality of side-by-side panels and a glue tab extending from one of the panels. A crease or score is optionally disposed between the side-by-side panels and the glue tab to facilitate folding of the box blank. The box is arranged into a generally rectangular shape so that an edge of a first panel and a glue tab are positioned adjacent to one another and on a perimeter of the box blank. The glue tab is secured to the first panel to form a glued box blank, wherein securing the glue tab to the first panel includes inserting the box blank into a first side of a gluing device. In one aspect, the gluing device is adapted for securely holding a portion of the glue tab in place, securely holding a portion of the first panel in place such that the edge of the first panel is positioned adjacent to the glue tab, applying glue to at least one of the glue tab and the edge of the first panel, and folding the glue tab onto the first panel with the glue therebetween.

In yet another embodiment of the present invention, a gluing device includes a gluing apparatus having a glue dispensing nozzle fluidly coupled to a glue supply, wherein the glue dispensing nozzle is operatively coupled to a track structure and a motorized drive assembly to facilitate movement of the glue dispensing nozzle from a first position to a second position so as to enable application of glue along a length of at least one edge surface of a box blank, the box blank having a plurality of side-by-side panels and at least one glue tab extending from a first panel of the box blank.

Additionally, the device includes a support plate configured for supporting the box blank as the glue dispensing nozzle applies glue thereto, at least one alignment means for aligning the box blank on the support plate substantially below the glue dispensing nozzle, and at least one sensor configured for detecting a first end and a second end of the glue tab, wherein the at least one sensor is operatively associated with the glue dispensing nozzle so as to cause the glue dispensing nozzle to apply glue to the box blank only between the first and second ends of the glue tab.

The device also includes a first clamp configured for selectively and securely holding at least a portion of glue tab on the support plate, a second clamp configured for selectively and securely holding a second portion of the packaging material on the support plate, and a folding apparatus configured for folding the glue tab onto an adjacent panel of the box blank after glue has been applied to at least one edge surface of at least one of the glue tab or the adjacent panel.

Optionally, the folding apparatus is configured for folding the first portion of the packaging material onto a second portion of the packaging material after glue has been applied to at least one edge surface of at least one of the first portion or the second portion.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which:

FIGS. 8B-13 illustrate cut-away views of the gluing device of FIG. 7 taken along the line 8B-13-8B-13 to show the actions of various components of the gluing device when gluing a glue tab to another panel of a box blank.

DETAILED DESCRIPTION OF THE PREFERRED EMBODIMENTS

The embodiments described herein extend to methods, devices, systems, assemblies, and apparatus for gluing objects. Such are configured to, for example, reliably glue objects in a simple and efficient manner.

Reference will now be made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the following description, numerous specific details are set forth in order to provide a thorough understanding of the present invention. It will be clear, however, to one of ordinary skill in the art that the present invention may be practiced without these specific details. In other cases, well known aspects of gluing devices and methods, general manufacturing techniques, and packaging products are not described in detail herein in order to avoid unnecessarily obscuring the novel aspects of the present invention.

FIGS. 1-13 and the following discussion are intended to provide a brief general description of exemplary devices in which embodiments of the invention may be implemented. While gluing apparatuses for gluing packaging is described below, this is but one single example, and embodiments of the invention may be implemented with other types of glueable objects. Accordingly, throughout the specification and claims, the phrases "glueable object," "glueable item," "packaging material," "box blank," and the like are intended to apply broadly to any type of item that can be glued with a system or device as described herein.

Figure 1:
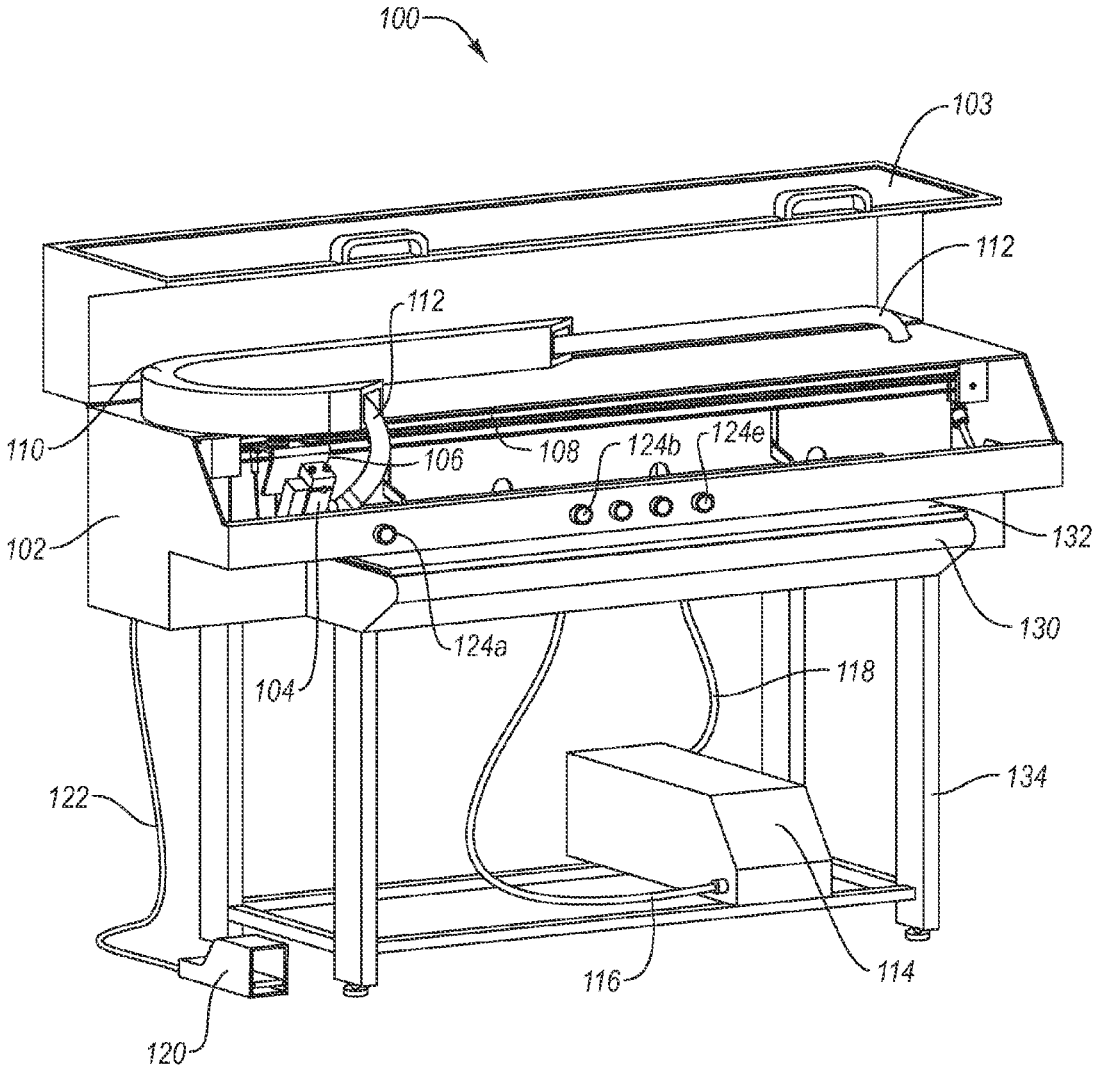
FIG. 1 illustrates a view of an exemplary gluing device, according to one embodiment of the present invention.

With reference to FIG. 1, an exemplary gluing device 100 configured for gluing a gluable item is broadly illustrated. For clarity, the gluing device 100 in FIG. 1 is shown with cover 103 in an open position; however, the gluing device 100 can be operated with the cover 103 open or closed. The gluing device 100 includes an outer housing 102, the cover 103, and a support plate 132 upon which a packaging material can be supported during a gluing process. As illustrated, the gluing device 100 is disposed on a support structure 130 (e.g., a table top) that includes a number of support legs 134. The support plate 132 may be integral to either the support structure 130 or to the outer housing 102 of the gluing device 100.

A glue dispensing apparatus 104 configured for dispensing glue onto a gluable item is disposed in the outer housing 102. The glue dispensing apparatus 104 is mounted on a mounting bracket 106, which is movably mounted to a track structure 108 such that the glue dispensing apparatus 104 can be selectively moved between a first position and a second position on the support structure to facilitate application of glue along a length of at least one edge surface of a gluable item. The gluing device 100 further includes a glue reservoir 114 (e.g., a hot glue reservoir) that is fluidly coupled to the glue dispensing apparatus 104 via lines 116, 118, and 112 and flexible conduit 110.

The gluing device 100 further includes a number of switches 124*a*-124*e* that may be used to change the mode of the device 100 from, for example, a manual mode where an operator manually initiates the gluing process to an automatic mode where the device 100 may automatically initiate the gluing device when a gluable item is inserted into the device 100. Additionally, a foot pedal 120 is coupled to the device 100 via a cord or line 122. The foot pedal 120 can be used to manually initiate the gluing process. Once the packaging material has been glued, and optionally stacked, additional packaging material can be glued in a similar manner with the gluing device.

Figure 2:
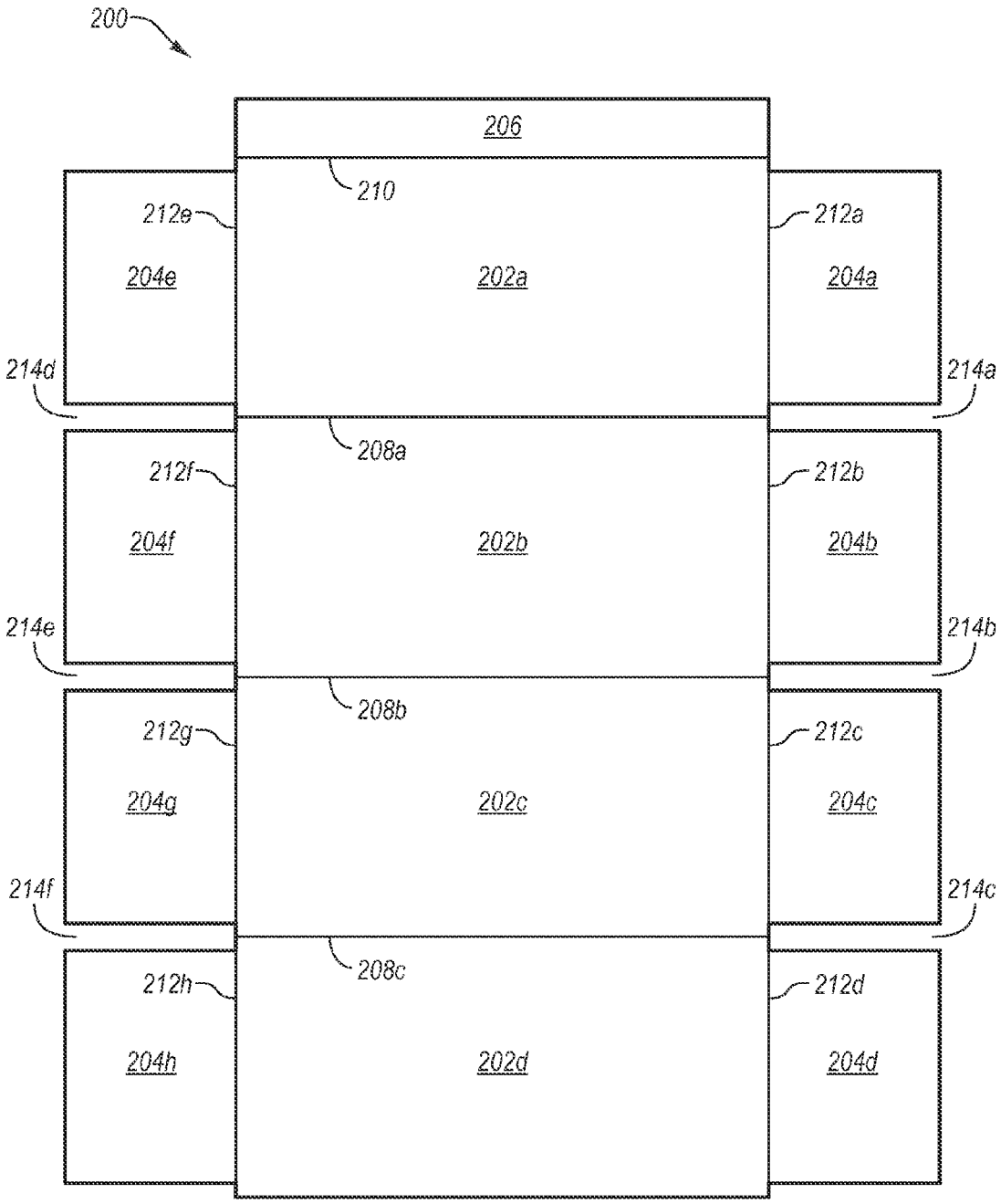
FIG. 2 illustrates a box blank that can be glued with the gluing device of FIG. 1.

Referring now to FIG. 2, an example of a corrugated box blank 200 that can be glued using the device 100 described herein is illustrated. The box blank 200 includes four side-by-side panels 202*a*-202*d* and a glue tab 206. The side-by-side panels 202*a*-202*d* and the glue tab 206 are separated by longitudinal creases 208*a*-208*c* and 210. Additionally, each panel includes transverse score lines 212*a*-212*h* and slots 214*a*-214*f* that define opposing flaps 204*a*-204*h*. The opposing flaps 204*a*-204*h* may be folded to create the top and bottom portions of a box. The longitudinal and transverse creases (208*a*-208*c* and 210 and 212*a*-212*h*), slots 214*a*-214*f*, and glue tab 206 can be formed with a creasing/slotting unit and/or a die cutter unit. Optionally, as will be described in greater detail below, the crease 210 disposed between the glue tab 206 and panel 202*a* can instead be formed by the gluing device.

Figure 3:
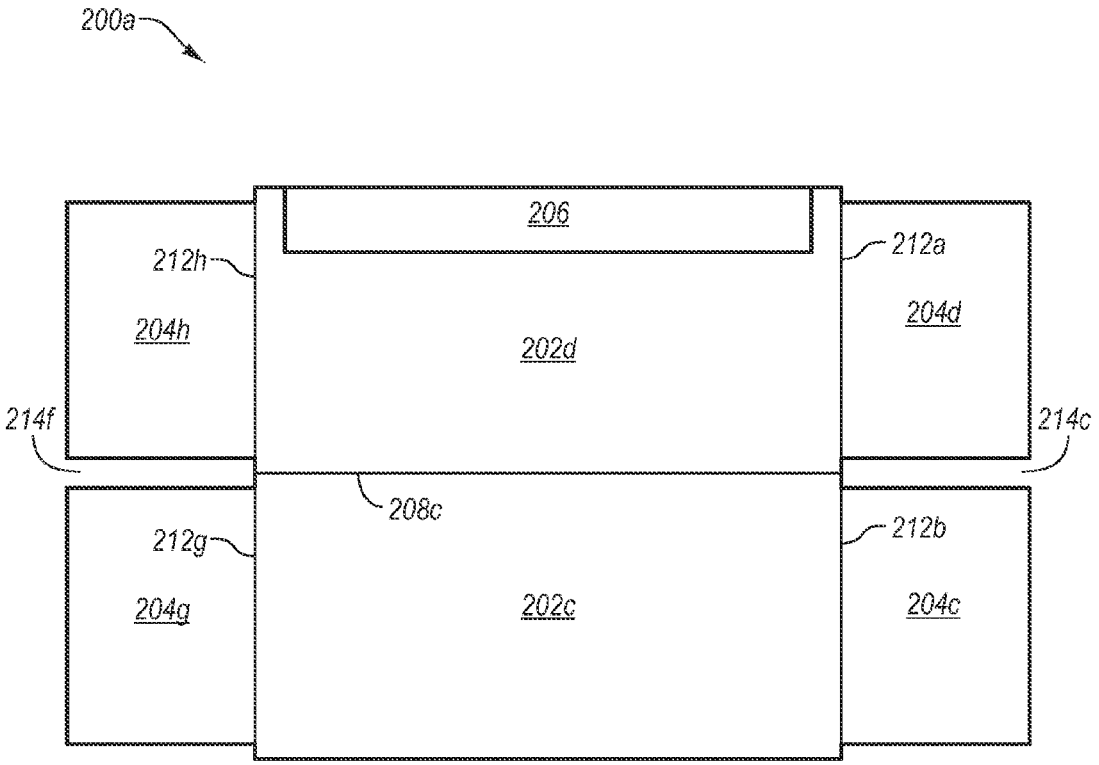
FIG. 3 illustrates the box blank of FIG. 2 having been glued with the gluing device of FIG. 1.

With the longitudinal and transverse creases (208*a*-208*c* and 210 and 212*a*-212*h*) and slots 214*a*-214*f* formed in the box blank 200, the box blank 200 can be folded along the crease line 208*b* as shown in FIG. 3, and the glue tab 206 can be attached to the adjacent panel 202*d* in order to form a box 200*a*. For reasons described below, it is notable that the box blank 202*a* as folded and glued in FIG. 3 has the glue tab 206 positioned at an edge of the box 200*a* rather than in the middle. It is also notable that the glue tab 206 is positioned on the outside of the adjacent panel 202*d* rather than inside the adjacent panel 202*d*.

Figure 4:
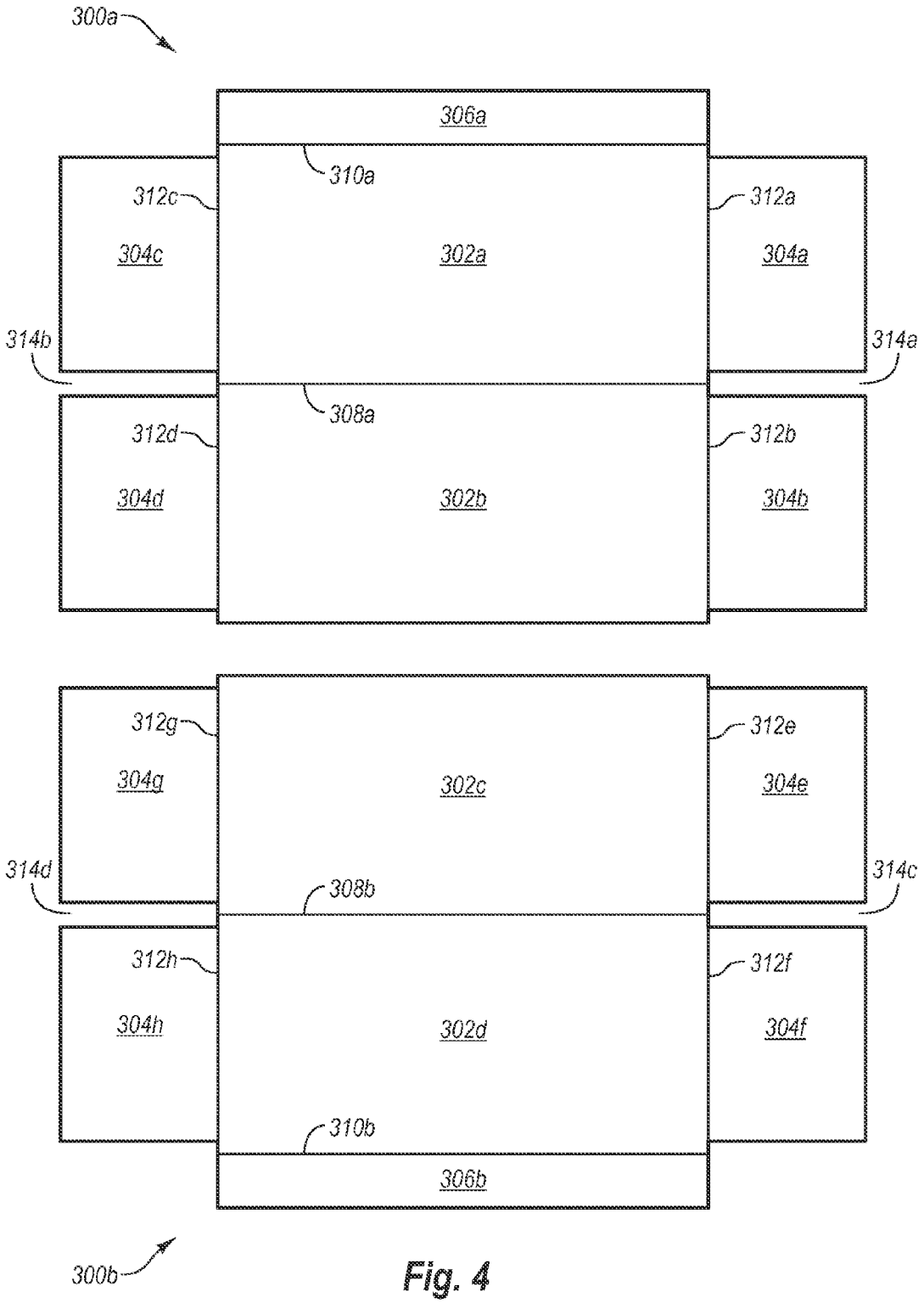
FIG. 4 illustrates a box blank in two separate parts that can be glued with the gluing device of FIG. 1.

FIG. 4 illustrates an alternative embodiment of a box blank that is separated into two separate pieces 300*a* and 300*b* that can be glued together to form a box. The box blank half 300*a* includes two side-by-side panels 302*a*-302*b* and a glue tab 306*a*. Likewise, the box blank half 300*b* includes two side-by-side panels 302*c*-302*d* and a glue tab 306*b*. The side-by-side panels 302*a*-302*b* and the glue tab 306*a* are separated by longitudinal creases 308*a* and 310*a*, respectively. Similarly, side-by-side panels 302*c*-302*d* and the glue tab 306*b* are separated by longitudinal creases 308*b* and 310*b*, respectively. Additionally, each of the side-by-side panels 302*a*-302*d* includes transverse score lines 312*a*-312*h* and slots 314*a*-314*d* that define opposing flaps 304*a*-304*h* that can be folded to create the top and bottom portions of a box. The longitudinal and transverse creases (308*a*-308*b*, 310*a*-310*b*, and 312*a*-312*h*), slots 314*a*-314*d*, and glue tabs 306*a*-306*b* can be formed with a creasing/slotting unit and/or a die cutter unit. Optionally, as will be described in greater detail below, the creases 310*a*-310*b* disposed between the glue tabs 306*a*-306*b* and the attached panel 302*a* and 302*d* can instead be formed by the gluing device.

Figure 5:
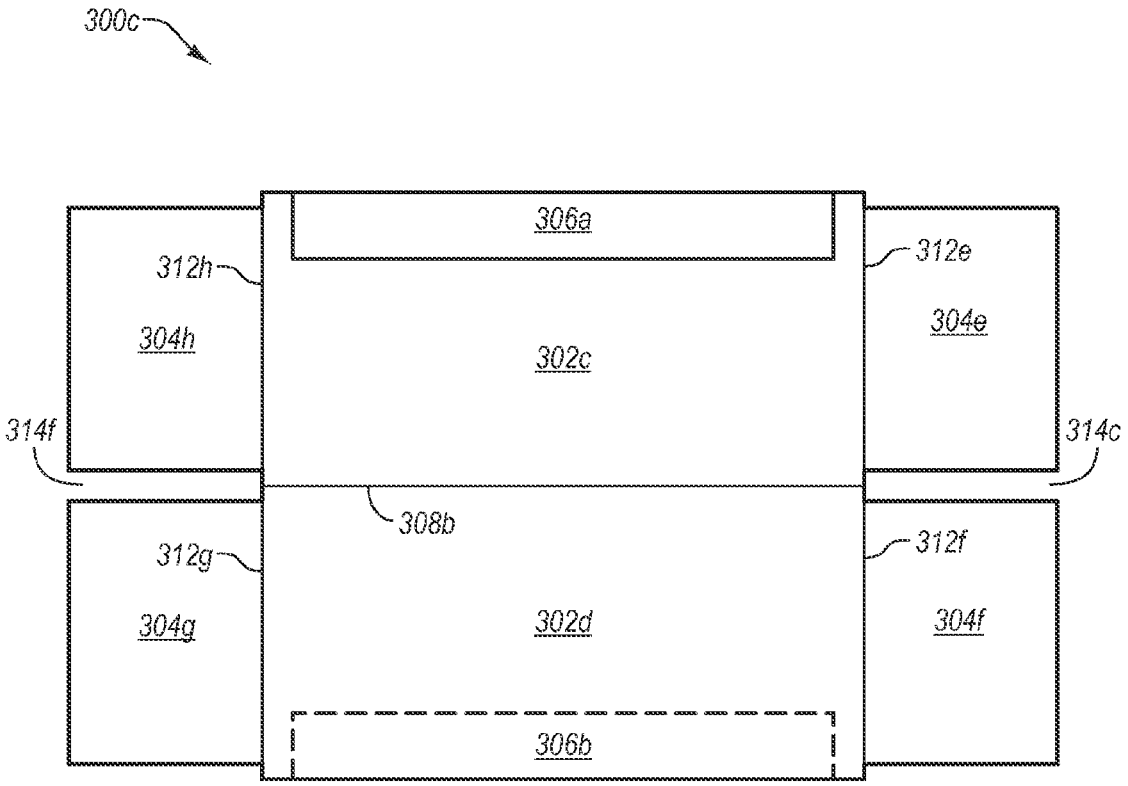
FIG. 5 illustrates the box blank of FIG. 4 having been glued with the gluing device of FIG. 1.

As illustrated in FIG. 5, to form a box 300*c*, the two box blank halves 300*a* and 300*b* can be overlaid on top of one another with the two glue tabs 306*a* and 306*b* on opposite ends. In a first gluing step, glue tab 306*a* can be attached to it corresponding adjacent panel 302*c* using the gluing device described herein. In a second gluing step, the two box blank halves 300*a* and 300*b*, which are now attached between glue tab 306*a* and panel 302*c*, can be removed from the device, rotated 180° and flipped over, and reinserted into the device so that glue tab 306*b* can be glued to its corresponding adjacent panel 302*b*.

Turning now to FIGS. 6-13, various views of the gluing device according some embodiments of the present invention are illustrated.

Figure 6:
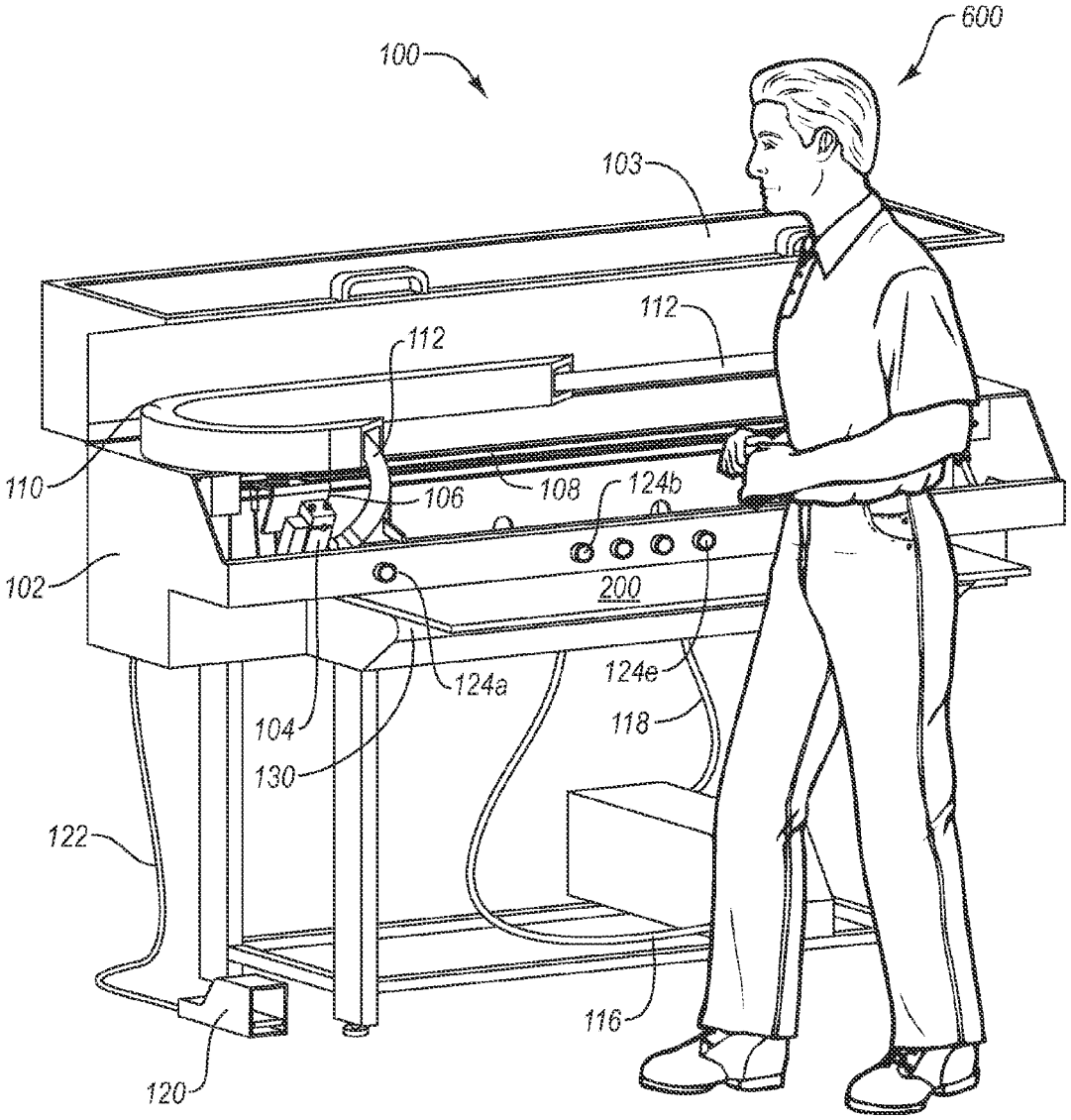
FIG. 6 illustrates a view of an exemplary gluing device and an operator.

FIG. 6 illustrates a perspective view of an exemplary gluing device 100 having a box blank 200 disposed on the support structure 130 for gluing in the gluing device 100. In addition, an operator 600 is included for the sake of scale.

Figure 7:
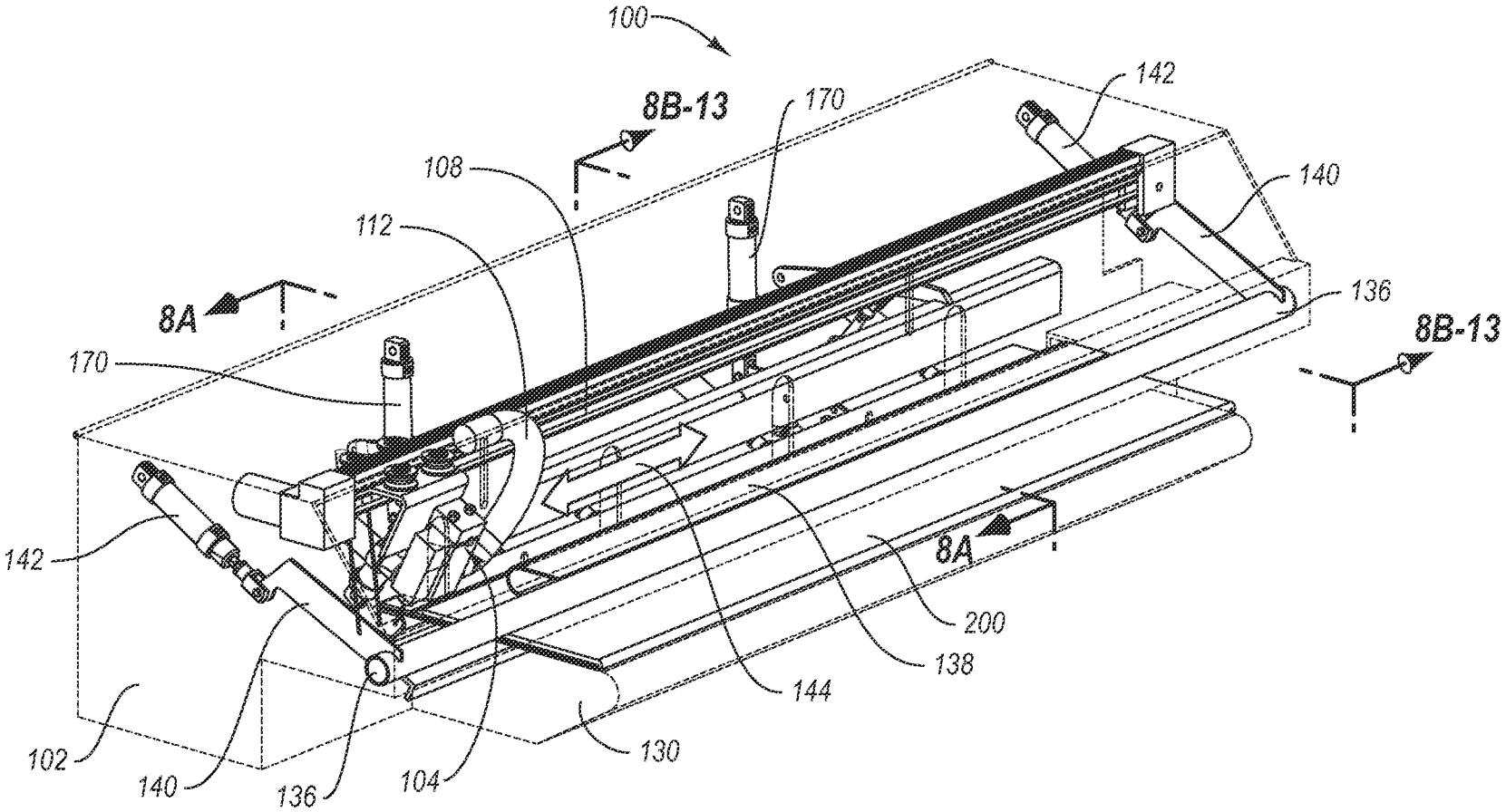
FIG. 7 illustrates a partial cut-away view of the exemplary gluing device of FIG. 6.

Referring now to FIGS. 6 and 7, a partial cut-away view of the gluing device 100 is additionally shown. As was discussed with reference to FIG. 1, the gluing device 100 includes an outer housing 102, the cover 103, and a support structure 130 (e.g., a table top) that includes a number of support legs 134. A glue dispensing apparatus 104 configured for dispensing glue onto the box blank 200 is disposed in the outer housing 102. The glue dispensing apparatus 104 is mounted on bracket 106, which is in turn coupled to track structure 108 such that the glue dispensing apparatus 104 can be selectively moved between a first position and a second position on the support structure to facilitate application of glue along a length of at least one edge surface of the box blank 200. The movement of the glue dispensing apparatus 104 from the first position to the second position is indicated by arrow 144 The gluing device 100 further includes a glue reservoir 114 (e.g., a hot glue reservoir) that is fluidly coupled to the glue dispensing apparatus 104 via conduits 116, 118, and 112 and flexible conduit 110. The flexible conduit 110 is configured, for example, to prevent the tangling of the lines 112 as the gluing apparatus 104 moves back and forth.

The gluing device 100 further includes a number of switches 124*a*-124*e* that may be used to change the mode of the device 100 from, for example, a manual mode where an operator manually initiates the gluing process to an automatic mode where the device 100 may automatically initiate the gluing device when a gluable item is inserted into the device 100. Additionally, a foot pedal 120 is coupled to the device 100 via a cord or line 122. The foot pedal 120 can be used to manually initiate the gluing process. Once the packaging material has been glued, and optionally stacked, additional packaging material can be glued in a similar manner with the gluing device.

Additionally, as can be seen in the partial cut-away view in FIG. 7, the gluing device 100 includes a numbers of actuating pistons (e.g., 142 and 170) and a number of actuator arms (e.g., 140) that can be used to actuate clamps (e.g., 136 and 138) and number of other devices that are adapted to perform the gluing and folding processes involved in gluing and folding a box blank 200. The devices adapted to perform the gluing and folding processes involved in gluing and folding a box blank 200 will be discussed in greater detail below in reference to FIGS. 8A-13.

Figure 8A:
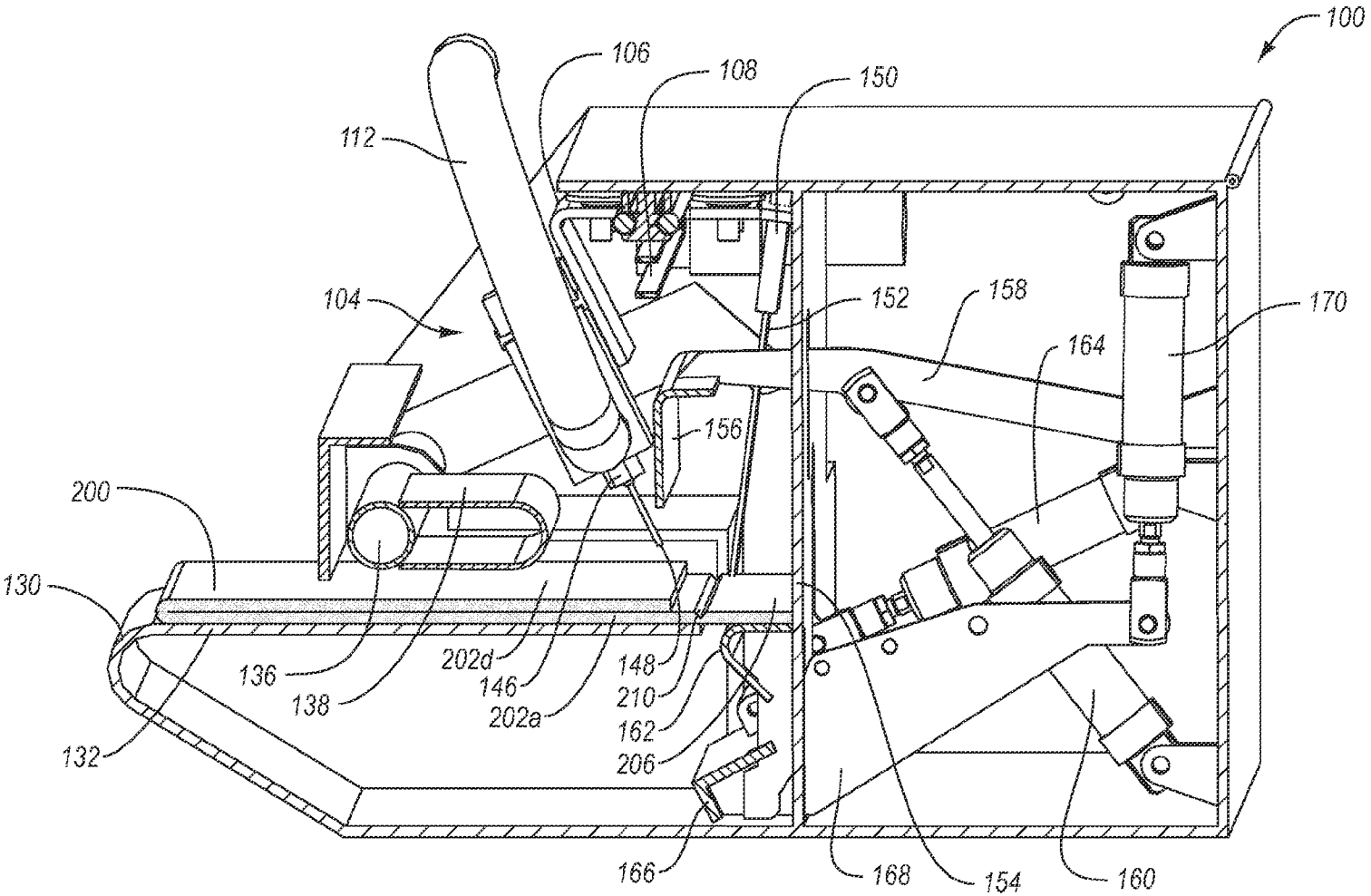
FIG. 8A illustrates a cut-away view of the gluing device of FIG. 7 taken along the line 8A-8A.
Figure 8B:
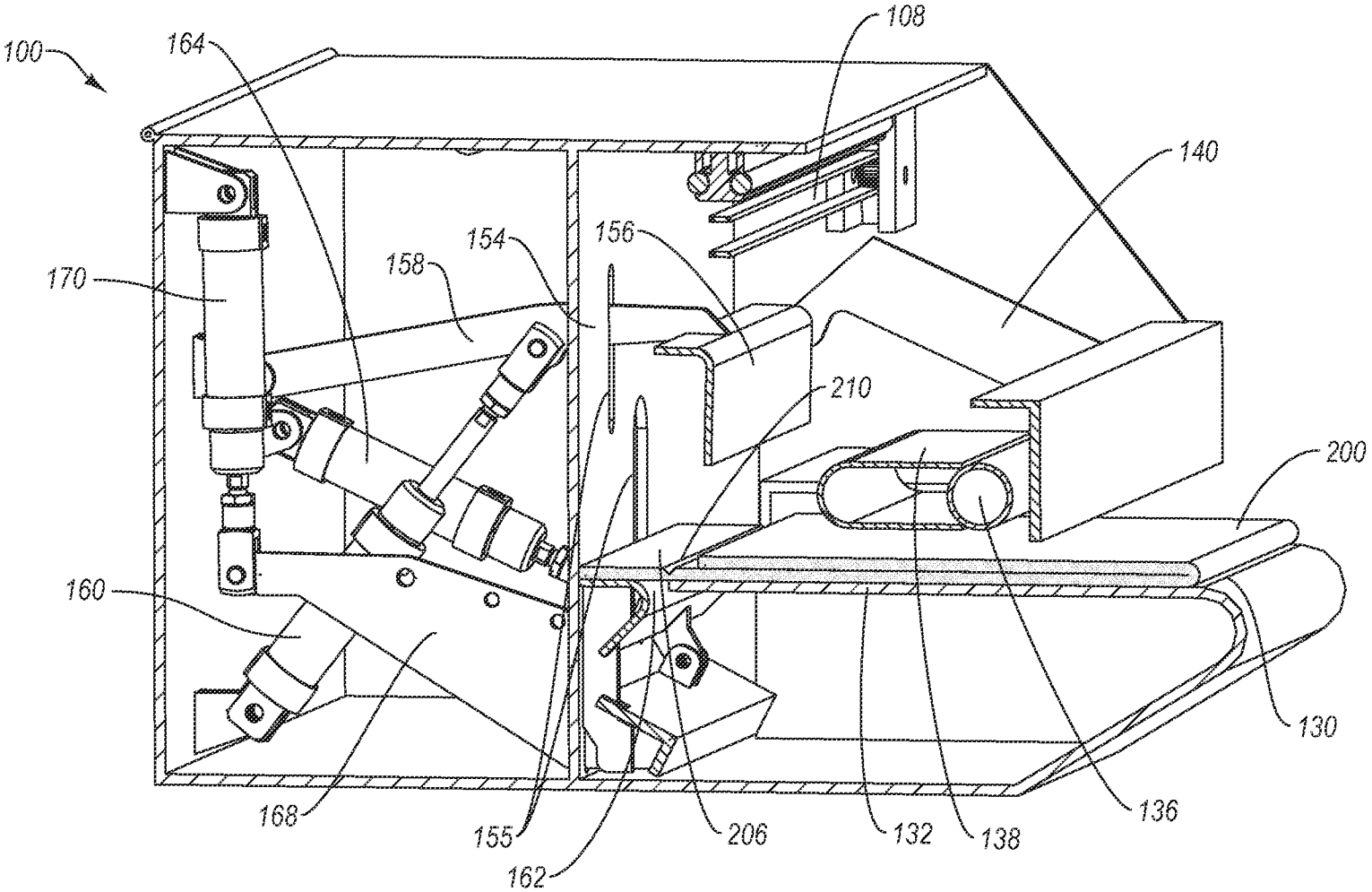

Referring now to FIGS. 8A and 8B, opposing cut-away views of the gluing device 100 taken along lines 8A-8A and 8B-13-8B-13 of FIG. 7 are shown. In FIGS. 8A and 8B, a box blank 200 is aligned and supported on the support structure 130 for gluing and assembly by the gluing device 100. The gluing device 100 includes a number of mechanical structures that are adapted for applying glue to the box blank 200 and folding and sealing the glue tab 206 onto the adjacent panel 202*d* of the box blank 200.

The gluing device 100 includes a first clamp 156 configured for selectively and securely holding a first portion (e.g., the glue tab 206) of the box blank 200 on the support plate 132 and a second clamp 136 and 138 configured for selectively and securely holding a second portion of the box blank 200 on the support plate 132. As shown in FIGS. 8A and 8B, the first and second clamps are in an "up" position. The positioning of the first clamp 156 is controlled by lever arm 158 and piston 160, which are coupled to one another and to the first clamp 156. The positioning of the first clamp 156 can be controlled by extending piston 160 for the "up" position or retracting the piston 160 for the "down" position. Similarly, the positioning of the second clamp 136 and 138 is controlled by levers 140 and pistons 142 (FIG. 7). As the gluing process proceeds, the first and second clamps 156 and 136/138 are able to cycle up to permit a box blank 200 to be inserted into the device 100, to cycle to a "down" position to securely hold the box blank 200, and to cycle back to the up position to release the glued box blank 200 so that it can be withdrawn from the device 100. The cycling of the clamps and the gluing process can be automatically initiated by insertion of the box blank 200 into the device 100 or it can be manually initiated by an operator.

Additionally, at least one of the support plate assembly 132 or the gluing device 100 includes an alignment means such as a guide rail, a stop, an alignment tab, markings, sensors, or another alignment means that facilitates the proper positioning of the box blank 200 on the support plate 132 so that glue can be applied to the proper parts of the box blank 200. In the embodiment illustrated in FIGS. 8A-13, the alignment means includes a dividing wall 154 that is disposed in the gluing device 100. As the box blank 200 is inserted into the gluing device 100, the glue tab 206 can be aligned against the dividing wall 154 to properly align the glue tab 206 and the box blank 200 for glue application and folding. In this manner, a user can quickly, conveniently, and correctly position a box blank 200 on the support plate 132 without requiring the user to visually inspect box blank's 200 position. The dividing wall 154 also includes a number of cutouts 155 configured to permit the clamps to cycle up and down during the gluing process. It will be appreciated by one of skill in the art, that the alignment means can be configured in any other manners without departing from the present invention.

The gluing apparatus further includes a glue dispensing apparatus 104 fluidly coupled to a glue supply (e.g., 144 in FIG. 6) via glue line 112. The glue dispensing apparatus 104 further includes a glue dispenser body 105 and a glue dispensing nozzle that includes a proximal portion 146 that is coupled to the body 105 and a distal portion 148 that projects toward the box blank 200. In the illustrated example, the glue dispensing apparatus 104 is movably mounted to the gluing device 100 on a track 108 with a number of wheels 107 such that the glue dispensing apparatus 104 can be selectively moved between a first position and a second position to facilitate application of a stream of glue along a length of at least one edge surface of the box blank 200.

The dispensing of glue through the dispensing nozzle 146/148 can be controlled by various mechanical mechanisms. For example, once a box blank 200 is positioned so that the dispensing nozzle 146/148 is adjacent the glue tab 206, the operator of the device may activate the dispensing nozzle 146/148 by way of a button, lever, switch, pedal, or the like (e.g., the foot pedal 120) to begin application of the glue to the box blank 200. Once a desired amount of glue has been applied to the glue tab 206 and/or adjacent panel 202*d*, the operator can deactivate the dispensing nozzle 146/148 using the same or a different button, lever, switch, pedal, or the like.

In one embodiment, a sensor 150 for detecting the presence of an object to be glued in the gluing device 100 is operatively coupled to the glue dispensing apparatus 104. The sensor 150 depicted in FIG. 8A is an infrared (IR) sensor capable of detecting the presence of a box blank 200 that is inserted into the device. The IR beam of the sensor 150 is schematically represented at 152. When the sensor detects the presence of a box blank 200 or another gluable item inserted into the device 100 below glue nozzle 146/148, the sensor can be configured to permit glue to be dispensed from the glue dispensing apparatus. For example, with a box blank 200 disposed below glue nozzle 146/148, as the glue dispensing apparatus 104 moves horizontally from the first position to the second position. The sensor 150 can be positioned such that the apparatus 104 will dispense glue only when the nozzle 146/148 is over the box blank 200. This prevents the glue dispensing apparatus 104 from dispensing glue where it is not needed. While an IR sensor system is described herein, one will appreciate that other types of optical, electronic, and mechanical sensors (e.g., laser based sensors, photodetector, motion detectors, proximity sensor, video camera, ultrasonic sensor, sonar sensor, radar sensor, a mechanical stylus, or any combination thereof) can be adapted to detect the presence of a gluable object in the gluing device and to direct application of glue to the selected portions of the gluable object.

In one embodiment, the sensor 150 can be linked to an automated system that detects the presence of the box blank 200 and that automatically directs the device 100 to begin dispensing glue onto the glue tab 206 and/or the adjacent panel 202*d*. The automated system can also detect when sufficient glue has been applied to the glue tab and/or adjacent panel or when the glue tab and/or box blank is no longer present at the dispensing nozzle. In either case, the automated system will deactivate the dispensing nozzle to stop the flow of glue therefrom.

The gluing device also includes a folding apparatus configured for folding the glue tab 206 of the box blank 200 onto an outside portion of the adjacent panel 202*d* of the box blank 200. The folding apparatus is configured to fold the glue tab onto the adjacent panel after glue has been applied to at least one edge surface of at least one of the glue tab or the adjacent panel.

The folding apparatus includes a first folding 162 bar that is configured to lift, smooth, and fold the glue tab 206 onto the adjacent panel 202*d* of the box blank 200. The positioning of the first folding bar 162 is controlled by at least one mechanical actuator (piston 164), which can be driven to lift, smooth, and fold the glue tab 206 onto the back side of the first clamp 156 and, after the first clamp 156 is lifted up, the first folding bar 162 can fold the glue tab 206 onto the adjacent panel 202*d* of the box blank 200. The folding apparatus also includes a second folding bar 166 that can come up under the distal end of the box blank 200 as the first folding bar 162 is folding the glue tab 206. The positioning of the second folding bar is controlled by lever arm 168 and at least one mechanical actuator (e.g., piston 170).

The second folding bar 166 is configured to support the support plate 132 under the distal end of the box blank 200. As such, the second folding bar 166 supports the support plate during the folding process and prevents the support from sagging down when the folding force is applied by the first folding bar 162. The second folding bar 166 is also configured to increase the efficiency of the folding process by working with the first folding 162 bar to act as a pinch clamp to press the glue tab 206 onto the adjacent panel 202*d* of the box blank 200. This arrangement of the first and second folding bars 162 and 166 permits the use of less rigid materials in the first and second folding bars 162 and 166 and the support plate. It also permits the use of fewer and less rigid internal structures in the device 100 because the device 100 pinches one edge of the box blank 200 to make the seal as opposed to having an arm that has to reach over to the middle of the box.

In one embodiment, the first and second folding bars 162 and 166 are separately and individually actuated by at least one mechanical actuator (e.g., pistons 164 and 170) that are adapted for cycling the first and second folding bars 162 and 166 through the series of movements in the folding process. In another embodiment, the first and second folding bars 162 and 166 are separately and individually actuated by a plurality of spaced apart mechanical actuators (e.g., pistons 164 and 170) that are adapted for cycling the first and second folding bars 162 and 166 through the series of movements in the folding process. The number of mechanical actuators needed is a function of the size of the device 100 (i.e., the length of the folding bars 162 and 166) and of the rigidity of the folding bars 162 and 166. If the device 100 is small and/or the folding bars 162 and 166 are particularly rigid, one or two mechanical actuators may be sufficient. However, in a larger device 100 and/or a device 100 having less rigid folding bars, 162 and 166 a number of mechanical actuators may be needed in order to apply sufficient folding/sealing pressure to seal the glue tab 206 onto the adjacent panel 202*d*.

In one embodiment, the plurality of spaced apart mechanical actuators are disposed about 20 cm to about 80 cm apart, or about 30 cm to about 60 cm apart, or, preferably, about 40 cm to about 50 cm apart. Actuating the first and second folding bars 162 and 166 with multiple mechanical actuators may increase the mechanical advantage of the first and second folding bars 162 and 166 and allow the application of more even pressure along the length of the box blank 200. Moreover, the use of multiple mechanical actuators may permit the use of first and second folding bars 162 and 166 that are less rigid without compromising the ability to apply evenly distributed pressure along the length of the box blank 200.

Figure 9:
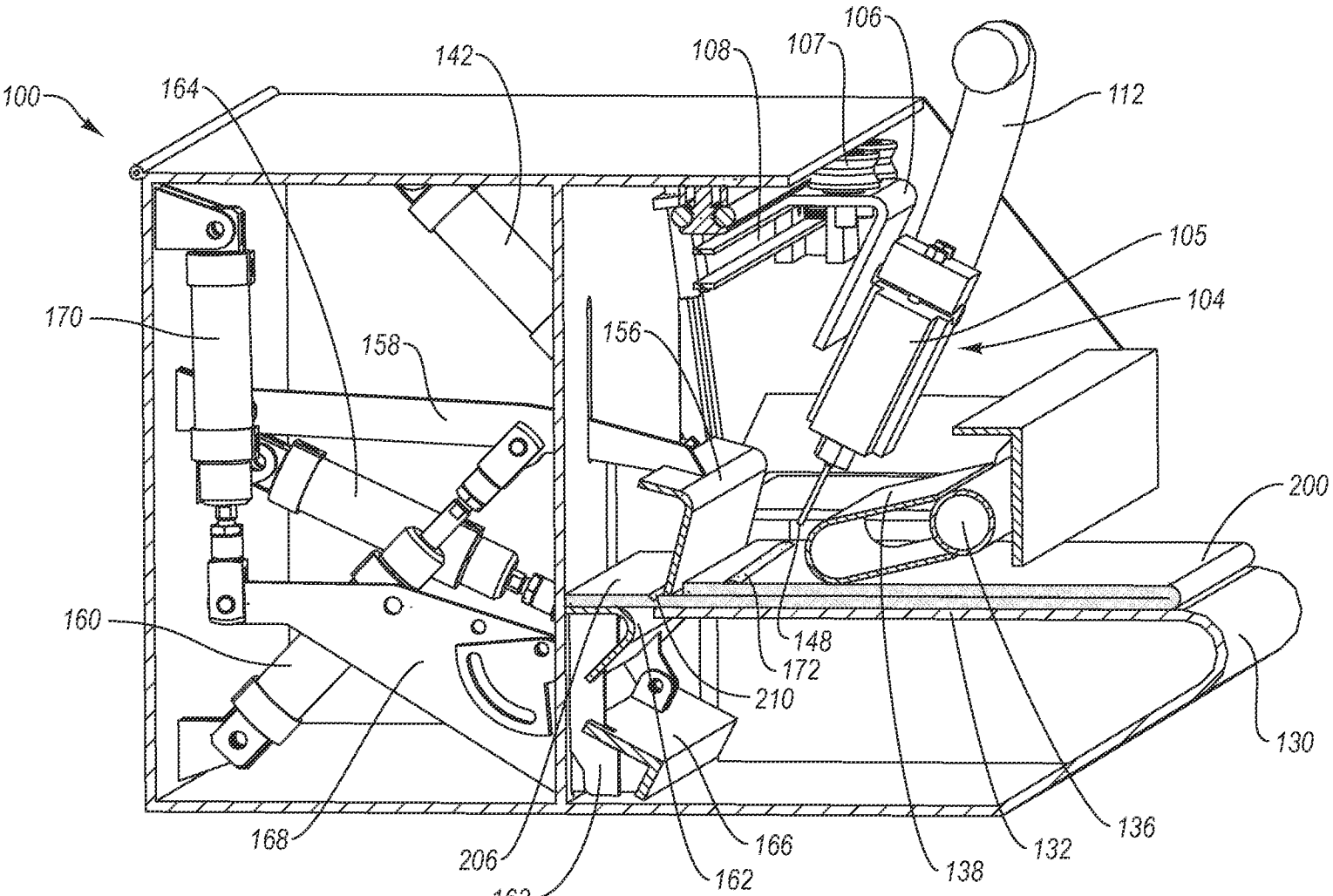
Figure 10:
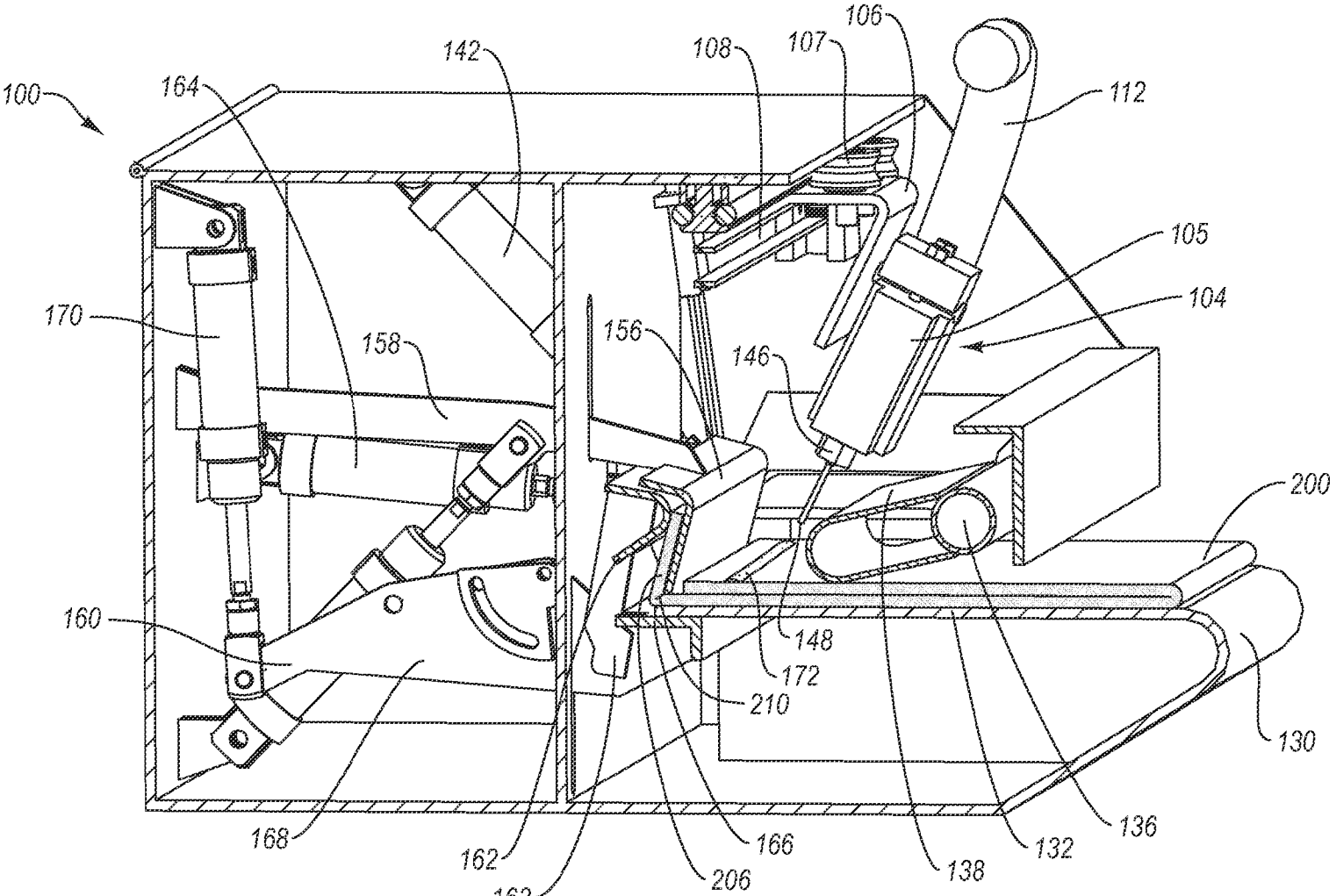

Referring now to FIGS. 9-13, additional stages in the folding process are illustrated. FIGS. 8A and 8B discussed above represent a first stage in the folding process where the box blank 200 is inserted into the folding device 100 and detected by the sensor 152. FIG. 9 represents a second stage of the folding process.

In the second stage, the first and second clamps 156 and 136/138 cycle to the down position to clamp the box blank 200 onto the support plate 132. The first clamp 156 is configured to hold at least one layer of the box blank 200 at the distal end of the box blank 200. For example, the first clamp 156 may come down on a portion of the glue tab 206 that has a crease 210 to facilitate holding of the glue tab 206 during the gluing process and folding of the glue tab 206 after glue has been applied to the box blank 200. In another example, the first clamp 156 may form the crease 210 in the glue tab 206. In yet another embodiment, the first clamp 156 may come down on a portion of adjacent panel 202*d* so to facilitate holding of both adjacent panel 202*d* and the glue tab 206 while glue is applied, as well as to facilitate folding of the glue tab 206 after glue has been applied. The second clamp 136/138 holds at least two layers of box material. For instance, the second clamp 136/138 can be lowered down on top of panel 202*c* and/or 202*d* within panels 202*a* and 202*b* respectively therebelow. In this manner second clamp 136/138 can hold the box blank 200 in place on top of the support plate 132. With the box blank 200 held firmly in place by the first and second clamps 156 and 136/138, the glue dispensing apparatus 104 can apply glue (e.g., a bead of glue shown schematically at 172) to at least one of the glue tab 206 or an outside portion of the adjacent panel 202*d* that will mate with the glue tab 206 when it is folded.

FIGS. 10-13 illustrate the steps in folding the glue tab 206 onto the adjacent panel 202*d*. In the illustrated embodiment, the folding bars 162 and 166 are configured for folding the glue tab 206 of the box blank 200 onto the adjacent panel 202*d* of the box blank 200 in at least two stages or steps. In the first step of the folding process illustrated in FIG. 10, the second folding 166 bar can be lifted up under the glue tab 206 and the distal end of the box 200 while the first folding bar 162 lifts, smoothes, and folds the glue tab 206 up past 90° against the back side the first clamp 156 with the first clamp 156 in the down position.

As noted, as the first folding bar 162 lifts up, it can smooth the glue tab 206 against the back side of the first clamp to ensure that the glue tab is flat and folded along the creased portion 210. This feature of the present invention is particularly advantageous when the box blank 200 is formed from a supply of endless packaging material, such as corrugated cardboard, that has been folded in a fanfold configuration. As will be understood, when a supply of an endless packaging material, such as corrugated cardboard, is folded in a fanfold configuration, creases or folds are formed in the packaging material.

The fanfold creases can cause some difficultly when forming boxes out of the packaging material. For instance, when a box blank is cut from a fanfolded packaging material, the fanfold crease may not align with the creases used to form the various panels of the box blanks. By way of example, a fanfold crease may extend down the middle of one of the panels or the glue tab. These fanfold creases can cause the box blank not to lie flat, which can cause the panels and glue tab not to readily align when the glue tab is to be glued. This can cause the operator to have to hold the panels and glue tab in place while the glue tab is being attached.

The gluing devices of the present invention minimizes the difficulties presented by fanfold creases. Since the gluing device of the present invention applies glue and attaches the glue tab when the glue tab is positioned on the edge of the box blank, the only time the fanfold creases pose any real difficulty is when the fanfold crease extends down the middle of the glue tab. However, the frequency with which the fanfold crease will extend down the middle of the glue tab is very minimal. Nevertheless, the first folding bar 162 cooperates with the first clamp 156 to smooth out any fanfold creases that may be present in the glue tab. Specifically, as the first folding bar 162 lifts the glue tab 206 up, the first folding bar 162 moves along the back side of the first clamp 156 so as to fold the glue tab 206 up against the back side of the first clamp 156. The first folding bar 162 is offset from the first clamp 156 just enough to allow the glue tab 206 to be positioned therebetween, but close enough to prevent any fanfold creases in the glue tab 206 from causing the glue tab 206 to fold or bunch. Thus, as the first folding bar 162 folds the glue tab 206 into the position shown in FIG. 10, any fanfold creases in the glue tab 206 will be smoothed out so that the glue tab 206 is ready to be attached to panel 202*d*.

Figure 11:
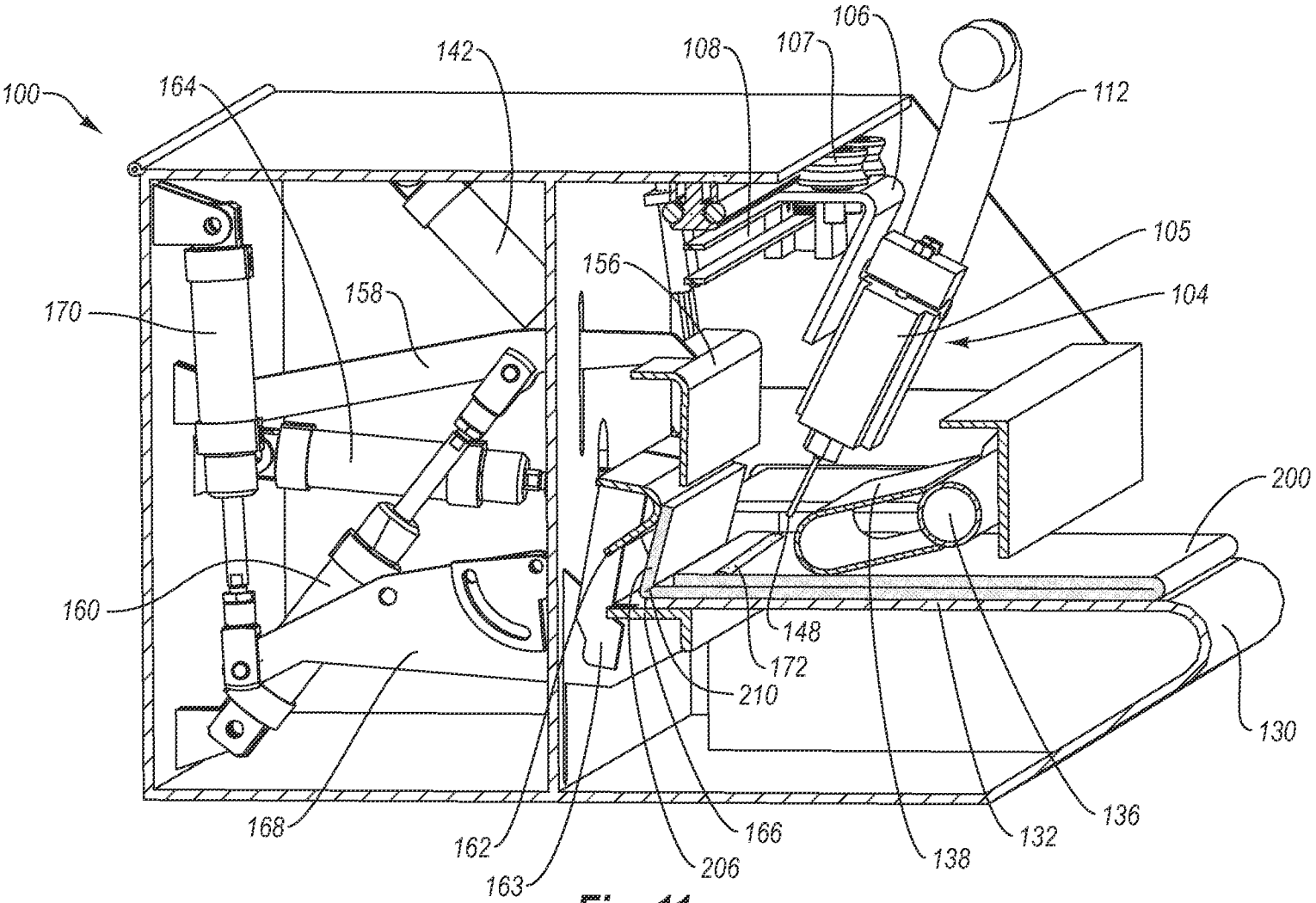
Figure 12:
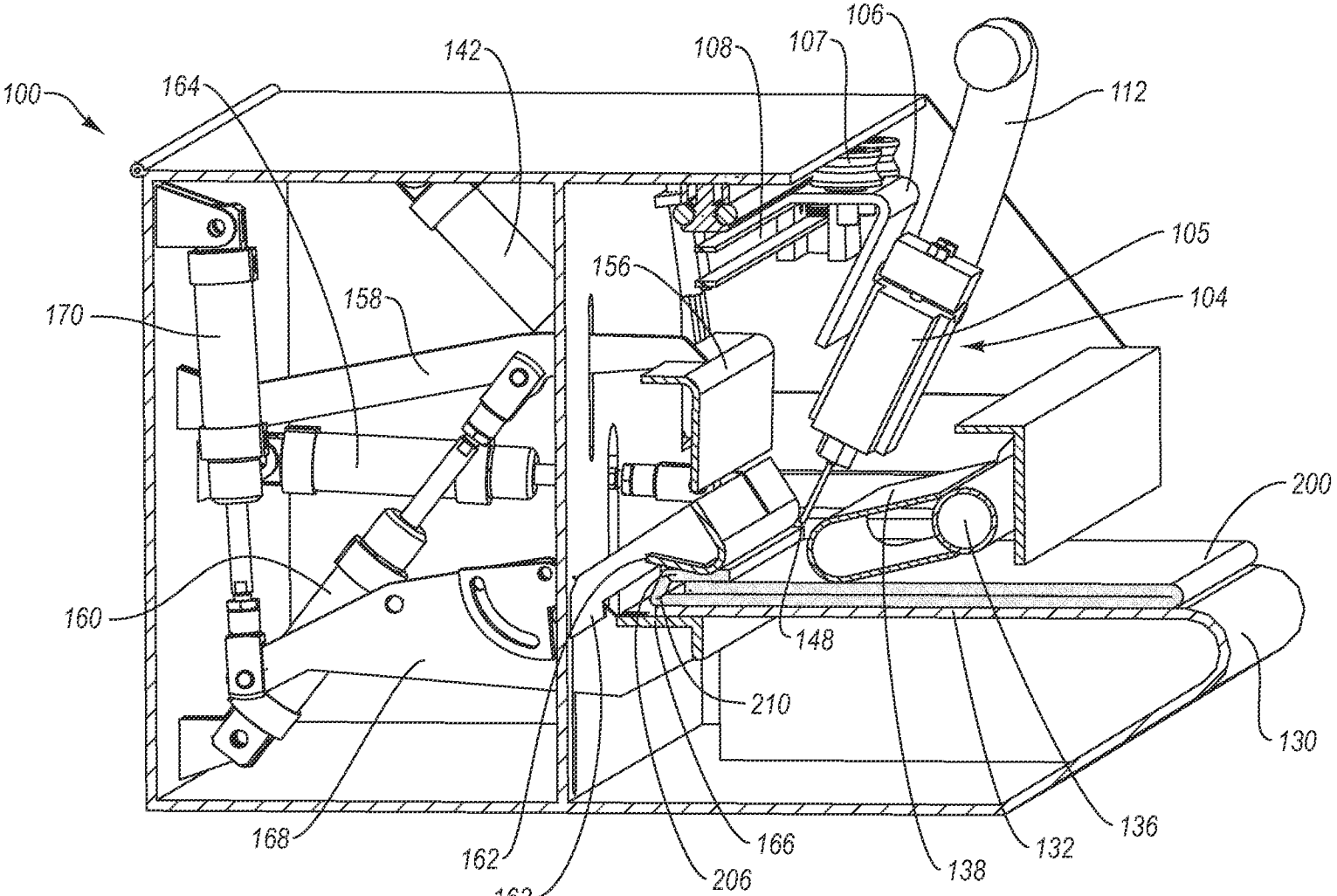
Figure 13:
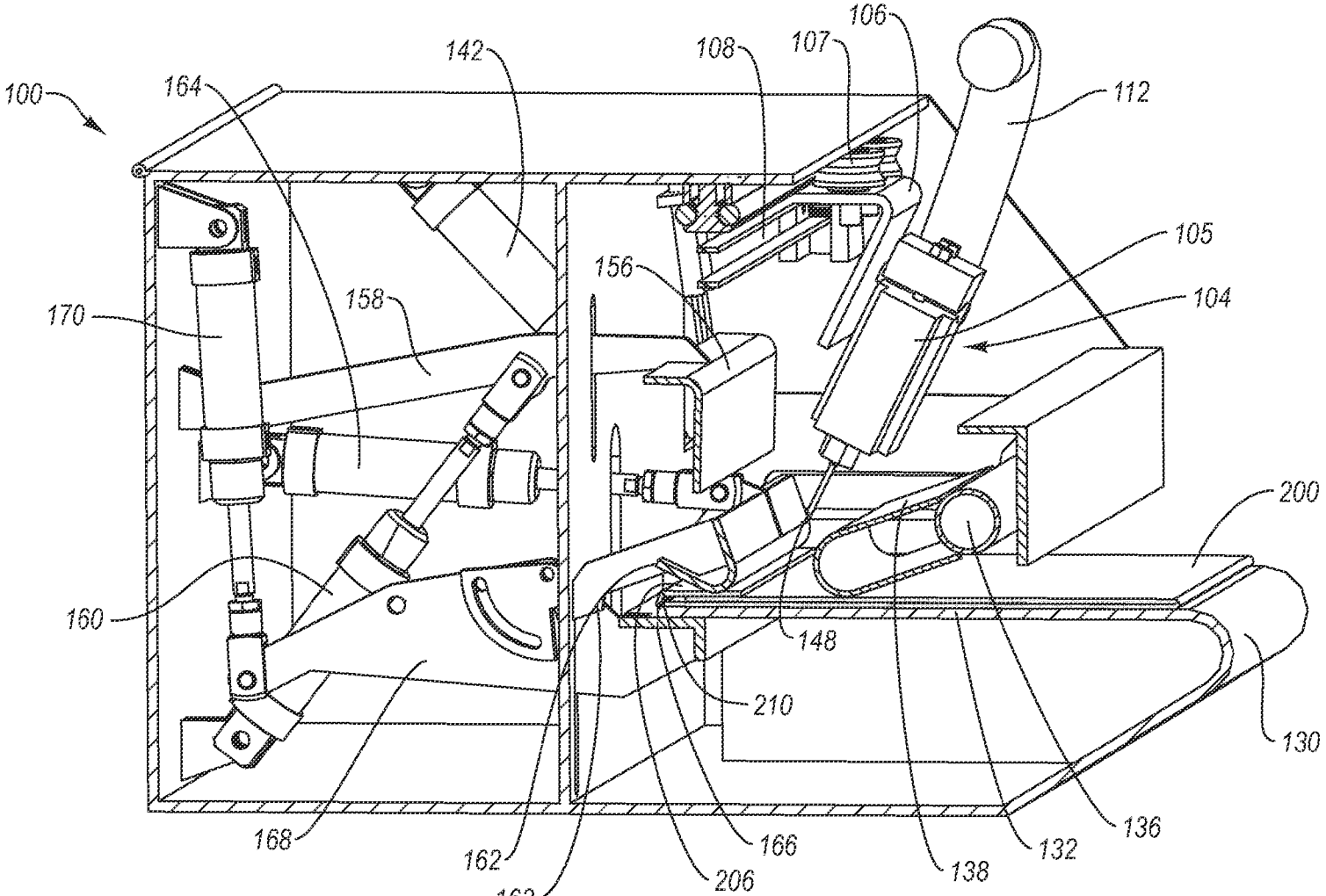

A second stage of the folding process is illustrated in FIGS. 11-13. As illustrated in FIG. 11, the first clamp 156 cycles up so that it lifts off of the glue tab 206. One of the reasons that the glue tab 206 is folded past 90° is illustrated in this step. When the first clamp 156 lifts up, the adjacent panel 202*d* may have a tendency to lift as well. However, because the glue tab 206 is angled over the adjacent panel 202*d*, the adjacent panel 202*d* cannot lift up past the glue tab 206. As such, if the adjacent panel 202*d* lifts up, the glue tab 206 can capture the adjacent panel 202*d* and press it back down as the folding process proceeds in the subsequent steps.

As illustrated in FIGS. 12 and 13, the first folding bar 162 folds the glue tab 206 onto the adjacent panel 202*d*. As the first folding bar 162 presses the glue tab down, a lever arm 163 that is coupled to the first folding bar 162 presses against the dividing wall 154 to drive the first folding bar 162 down and forward to press the glue tab onto the adjacent panel 202*d*. In a similar fashion, the second folding bar 166, which is lifted up, works with the first folding bar 162 to press the glue tab 206 onto the adjacent panel 202*d*. As can be seen in FIGS. 12 and 13, the first and second folding bars 162, 166 are positioned on opposing sides of the box blank 200. This configuration of the first and second folding bars 162, 166 allows them to act as a pinching clamp to firmly press the glue tab 206 onto panel 202*d*. Notably, because the box blank 200 is glued with the glue tab 206 on the edge rather than in the middle, the pinching force required of the first and second folding bars 162, 166 is much smaller that the force typically required in large C-frame gluing devices.

Once the glue tab 206 is glued and folded onto the adjacent panel 202*d*, the glued box blank 200 can be withdrawn from the gluing device from the side that it was inserted into the device. In one embodiment, the glue dispensing apparatus 104 is able to cycle back to the first position while the steps in the process of folding the glue tab 206 onto the adjacent panel 202*d* are proceeding. This allows the device 100 to recycle so that additional boxes can be glued more quickly using the gluing device. In particular, as the glue tab 206 is being folded onto panel 202*d*, the glue dispensing apparatus can move back to the first position (as shown in FIG. 7). As soon as the glue tab 206 has been folded and secured to panel 202*d* and the box blank 200 has been removed from gluing device 100, another box blank 200 can be inserted and glue dispensing apparatus 104 will be ready to apply glue thereto.

As noted above, many typical gluing devices are configured to glue box blanks which are folded so the glue tab is positioned in the middle of the box blank, thus requiring a large frame that can reach the middle of the box blank in order to apply the glue to the glue tab and press the glue tab against the adjacent panel. The configuration of these large frames makes it more difficult to apply the glue and pressure to the box blanks. Additionally, these large frames occupy significant amounts of valuable space. Furthermore, the large size of typical gluing devices means that the distance and time required of a handler to process a box blank through the various machines (i.e., the box cutting/creasing device, gluing device, etc.) is greater than if the devices were smaller.

The gluing device 100 of the present invention is sized and configured to fit within a relatively small area so that the device 100 can be placed in close proximity to other box processing devices. This leads to less distance and time required of a handler to process each box. For instance, the gluing device 100 of the present invention is adapted to glue a box blank when the box blank is folded so the glue tab is positioned on an edge of the box blank, as illustrated, for example, in FIGS. 3 and 5. The gluing device 100 of the present invention thereby eliminates the need for a large frame in order to apply glue to the glue tab. Rather, the gluing device 100 of the present invention is able to apply glue to any size box blank without any adjustment, while maintaining the compact nature of the device so that the device can be positioned relatively close to other devices.

The gluing device of the present invention can be sized to glue one or more box blanks at a time. For example, as described above, the gluing device can receive and glue a single box blank at a time. Alternatively, the gluing device can be adapted to receive multiple box blanks at one time. For example, multiple box blanks can be positioned and secured in place with the clamp arm. Glue can then be applied to each of the box blanks and the folding bar can be used to simultaneously fold each of the glue tabs for the multiple box blanks. Furthermore, the multiple box blanks may be distinct box blanks which are individually placed on the support plate, or the box blanks may be attached to one another as a unit such that the unit is placed on the support plate at one time. In the case of the attached box blanks, the box blanks can be adapted to be readily detached from one another after the gluing process is complete. In this manner multiple box blanks can be glued in a single gluing process, thereby increasing the number of boxes that can be formed in a given time period.

As noted above, one of the advantageous features of the present invention is that box blanks of various sizes can be glued without having to adjust the configuration or settings of the gluing device. For example, gluing device 100 can be used to glue the glue tab of a very large box blank by simply inserting the portion of the box blank with the glue tab into the gluing device, as described above. Once the large box blank has been glued, another box blank of a different size can be immediately glued with gluing device 100 by following the same procedure. There is no need to reconfigure or adjust any parts of gluing device 100 in order to accommodate box blanks of different sizes. Thus, the gluing device of the present invention enables on-demand, or custom sized boxes to be glued one after another without any downtime to adjust the gluing device.

This feature of the invention is in contrast to most typical gluing devices that require specific settings for each size box. More specifically, most box gluing device are configured to glue box blanks in batches based on the size of the box blanks. For instance, the gluing device can be set to glue a 20"×20"×20". With these settings, a batch of box blanks, anywhere from dozens to hundreds of box blanks, will be glued. These box blanks are then stacked and shipped to consumers. When another batch of box blanks of a different size, for example 10"×8"×6", needs to be glued, the setting of the gluing device must be reset to accommodate the different sized box blanks. Thus, each time a new size box blank needs to be glued, the settings of the gluing device need to be adjusted. In contrast, the gluing device of the present invention is designed to gluing various sized box blanks one after another without having to make any adjustments to the gluing device.

Returning attention to FIGS. 1 and 8A-13, the glue dispensing apparatus 104 is attached to a glue source 114. In the illustrated embodiment, the glue source 114 includes a reservoir of glue that is attached to the dispensing nozzle by way of conduits 116 and/or 118 through which the glue is communicated between the reservoir 114 and the glue dispensing apparatus 104. The conduits 116 and/or 118 can be any suitable structure for transporting the glue, including but not limited to pipes, tubes, hoses, and the like. The glue dispensing apparatus 104 can also include a pump to facilitate the transfer of glue from the reservoir to the dispensing nozzle.

The gluing device 100 can be adapted for use with various types of glues. For example, when hot melt glue is used, such as a thermoplastic, the glue reservoir 114 can include a heating element in order to melt the glue. The melted glue can then be transferred to the glue dispensing apparatus 104 through the conduits 116 and/or 118. Other types of glues which can be used with the gluing device 100 include cold glues, epoxies, elastomers, polymer-based adhesives, contact adhesives such as neoprene, and pressure sensitive adhesives.

While the glue dispensing apparatus 104 of the present embodiment is described and illustrated as being attached via a conduit to a reservoir of glue 114, it will be appreciated that various other types of glue dispensing apparatuses 104 can be used with the gluing device 100 of the present invention. For example, a glue applicator that includes a refillable cartridge for glue sticks and a built in heating element for melting the glue prior to application can be used. One example of such a suitable glue applicator is a 3M Scotch Weld Hot Melt applicator. Such a glue applicator can be simple and convenient to use. For example, the glue dispensing apparatus 104 can be mounted to the gluing device 100 support structure as described herein. A user can readily activate the glue dispensing apparatus 104 by pressing a button, pulling a trigger, and the like. One of ordinary skill in the art will readily recognize other suitable types of glue applicators than can be used with the gluing device of the present invention.

According to another embodiment of the present invention, a method for constructing a box is disclosed. The method includes providing a box blank (e.g., box blank 200 of FIGS. 2 and 3) that has a plurality of side-by-side panels and a glue tab extending from one of the panels. A crease or score is optionally disposed between the side-by-side panels and the glue tab to facilitate folding of the box blank. The box is arranged into a generally rectangular shape so that an edge of a first panel and a glue tab are positioned adjacent to one another and on a perimeter of the box blank. The glue tab is secured to the first panel to form a glued box blank, wherein securing the glue tab to the first panel includes inserting the box blank into a first side of a gluing device. In one aspect, the gluing device is adapted for securely holding a portion of the glue tab in place, securely holding a portion of the first panel in place such that the edge of the first panel is positioned adjacent to the glue tab, applying glue to at least one of the glue tab and the edge of the first panel, and folding the glue tab onto the first panel with the glue therebetween.

In one embodiment of the method described herein, the box blank in inserted into a first side of the gluing device for gluing and the glued box blank is withdrawn from the same side of the gluing device. This allows the gluing device described herein to occupy a much smaller footprint relative to gluing machines that feed unfolded, unglued boxes into one side of a machine and feed folded and glued boxes out of the other side of the machine.

The gluing device can also include various features that increase the convenience of the gluing device. For example, the support structure of the gluing device can have wheels or casters mounted thereon. The wheels or casters facilitate ready movement of the gluing device. Additionally, the gluing device can be formed or retrofitted with a larger support plate than the one illustrated. A larger support plate can be useful when gluing relatively large boxes. In particular, the larger support plate allows more of, if not all of the box blank to rest thereupon, thereby requiring less effort on the part of the operator to maintain the box blank in the proper orientation as the box blank is glued. Rather than using a larger support plate, however, a separate table can be positioned adjacent to the gluing device.

While the various embodiments of the present invention have been shown and described as being able to glue a box blank in a generally horizontal orientation, it will be appreciated that the gluing device of the present invention can be oriented in any desired manner. For example, the support structures, support plates, glue applicators and the like of the various embodiments can be positioned at various angles. In this manner, the gluing device of the present invention can be adapted to receive and glue a box blank in horizontal, vertical, or any other orientation therebetween. Reconfiguring the gluing device in a more vertical manner can provide significant savings in terms of square footage used in a warehouse or other facility.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A gluing device that applies glue to a packaging material and folds a first portion of the packaging material onto a second portion of the packaging material with the glue therebetween, comprising:

a support structure;

a support plate coupled to the support structure, wherein the support plate supports the packaging material thereon;

a gluing apparatus having a glue dispensing nozzle coupled to a glue supply, the glue dispensing nozzle being movably mounted to the support structure such that the glue dispensing nozzle is selectively movable between a first position and a second position on the support structure to facilitate application of glue along a length of the second portion of the packaging material;

a first clamp positioned to a first side of the glue dispensing nozzle and that selectively and securely holds the first portion of the packaging material against the support plate, the first clamp being movable between a first position and a second position, wherein, in the first position, the first clamp presses the first portion of the packaging material against the support plate to securely hold the packaging material against the support plate while the gluing apparatus applies glue to the second portion of the packaging material, and wherein, in the second position, the first clamp permits the packaging material to be inserted into or withdrawn from the gluing device;

a second clamp spaced apart from the first clamp and positioned to a second side of the glue dispensing nozzle opposite to the first clamp such that the glue dispensing nozzle can apply glue to at least a part of the second portion of the packaging material that is disposed between the first clamp and the second clamp, the second clamp selectively and securely holds the second portion of the packaging material against the support plate, the second clamp being movable between a first position and a second position, wherein, in the first position, the second clamp presses the second portion of the packaging material against the support plate to securely hold the packaging material against the support plate while the glue dispensing nozzle applies glue to the second portion of the packaging material, and wherein, in the second position, the second clamp permits the packaging material to be inserted into or withdrawn from the gluing device; and a folding apparatus positioned to the second side of the glue dispensing nozzle such that the gluing apparatus is disposed at least partially between the second clamp and the folding apparatus, the folding apparatus folds and presses the first portion of the packaging material onto the second portion of the packaging material after glue has been applied to the second portion to secure together the first portion and the second portion, wherein the folding apparatus folds and presses the first portion of the packaging material onto the second portion of the packaging material while the second clamp securely holds the second portion of the packaging material against the support plate.

2. The gluing device of claim 1, wherein the glue dispensing nozzle is operatively coupled to a track structure that facilitates movement of the glue dispensing nozzle between the first and second positions.

3. The gluing device of claim 1, further comprising at least one alignment means for aligning the packaging material on the support plate substantially below the glue dispensing nozzle.

4. The gluing device of claim 1, wherein the second portion of the packaging material includes a plurality of panels arranged side-by-side in a row, the packaging material being foldable such that a first panel disposed at a first end of the row is positioned adjacent a second panel disposed at a second end of the row opposite the first end, the second clamp simultaneously holding the first and second panels of the packaging material against the support plate.

5. The gluing device of claim 1, wherein the second clamp aligns an edge of the second portion of the packaging material against the first clamp.

6. The gluing device of claim 1, further comprising at least one sensor that detects the presence of the packaging material below the glue dispensing nozzle.

7. The gluing device of claim 1, wherein the folding apparatus folds the first portion of the packaging material onto the second portion of the packaging material in at least two stages;

in a first stage, the first portion is folded past 90° with the first clamp holding the first portion; and in a second stage, the first portion is folded onto the second portion after the first clamp is lifted off of the first portion.

8. The gluing device of claim 1, wherein the folding apparatus includes at least a first folding bar and a second folding bar:

the first folding bar folds the first portion of the packaging material onto the second portion of the packaging material; and the second folding bar supports the packaging material under the first folding bar to facilitate sealing the first portion of the packaging material onto the second portion of the packaging material, wherein the first folding bar and the second folding bar are actuated by at least one mechanical actuator.

9. The gluing device of claim 8, wherein the first folding bar and the second folding bar are separately and individually actuated by a plurality of spaced apart mechanical actuators.

10. A gluing device that applies glue to a packaging material and folds a first portion of the packaging material onto a second portion of the packaging material with the glue therebetween, comprising:

a support structure;

a support plate coupled to the support structure, wherein the support plate supports the packaging material thereon;

a first clamp that selectively and securely holds the first portion of the packaging material against the support plate, the first clamp being movable between a first position and a second position, wherein, in the first position, the first clamp presses the first portion of the packaging material against the support plate to securely hold the packaging material against the support plate, and wherein, in the second position, the first clamp permits the packaging material to be inserted into or withdrawn from the gluing device;

a second clamp spaced apart from the first clamp and that selectively and securely holds the second portion of the packaging material against the support plate, the second clamp being movable between a first position and a second position, wherein, in the first position, the second clamp presses the second portion of the packaging material against the support plate to securely hold the packaging material against the support plate, and wherein, in the second position, the second clamp permits the packaging material to be inserted into or withdrawn from the gluing device;

a gluing apparatus having a glue dispensing nozzle coupled to a glue supply, the glue dispensing nozzle being movably mounted to the support structure such that the glue dispensing nozzle is selectively movable between a first position and a second position on the support structure to facilitate application of glue along a length of the second portion of the packaging material while the first clamp and the second clamp securely hold the first portion and the second portion, respectively, of the packaging material against the support plate, the glue dispensing nozzle extending between the first clamp and the second clamp such that the first clamp is disposed on a first side of the glue dispensing nozzle and the second clamp is disposed on a second side of the glue dispensing nozzle opposite the first clamp; and a folding apparatus disposed on the first side of the glue dispensing nozzle such that the folding apparatus and the second clamp are disposed on opposite sides of the gluing apparatus, the folding apparatus folds and presses the first portion of the packaging material onto the second portion of the packaging material after glue has been applied to the second portion to secure together the first portion and the second portion, wherein the folding apparatus i) folds the first portion of the packaging material against the first clamp while the first clamp is in the first position, and ii) folds the first portion of the packaging material onto the second portion of the packaging material when the first clamp is in the second position.

11. The gluing device of claim 10, wherein the first clamp and the folding apparatus are separately motorized to facilitate holding and folding of the packaging material.

12. The gluing device of claim 10, wherein the first clamp holds both the first portion and the second portion of the packaging material against the support plate.

13. The gluing device of claim 10, wherein the first clamp is motorized to facilitate holding the first portion of the packaging material.

14. The gluing device of claim 10, wherein the gluing apparatus dispenses hot glue.

15. The gluing device of claim 10, wherein the packaging material comprises a box blank having multiple side-by-side panels arranged in a row and a glue tab extending from an edge of one of the panels at an end of the row.

16. The gluing device of claim 15, further comprising at least one sensor that detects a first end and a second end of the glue tab, the at least one sensor being operably associated with the glue dispensing nozzle so as to cause the glue dispensing nozzle to dispense glue onto the second portion of the box blank between the first end and the second end of the glue tab.

17. The gluing device of claim 15, wherein the glue dispensing nozzle dispenses glue onto an outer surface of a panel such that the glue tab can be glued to the outer surface of the panel.

18. The gluing device of claim 10, wherein the first clamp is positioned relative to glue dispensing nozzle on a side opposite to the second clamp.

* * * * *